US009145635B2

(12) United States Patent
Woo et al.

(10) Patent No.: US 9,145,635 B2
(45) Date of Patent: Sep. 29, 2015

(54) LAUNDRY TREATMENT APPARATUS

(71) Applicant: LG ELECTRONICS INC., Seoul (KR)

(72) Inventors: Seyoung Woo, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/185,093

(22) Filed: Feb. 20, 2014

(65) Prior Publication Data

US 2014/0285076 A1 Sep. 25, 2014

(30) Foreign Application Priority Data

Mar. 21, 2013 (KR) ..... 10-2013-0030404

(51) Int. Cl.

| | |
|---|---|
| ***D06F 37/00*** | (2006.01) |
| ***D06F 37/28*** | (2006.01) |
| ***D06F 58/04*** | (2006.01) |
| ***D06F 39/14*** | (2006.01) |

(52) U.S. Cl.

CPC ..... *D06F 37/28* (2013.01); *D06F 39/14* (2013.01); *D06F 58/04* (2013.01)

(58) Field of Classification Search

CPC ..... D06F 37/00; D06F 37/10; D06F 37/18; D06F 37/14

USPC ..... 312/228, 326, 329; 49/386, 387

See application file for complete search history.

(56) References Cited

U.S. PATENT DOCUMENTS

| | | | | |
|---|---|---|---|---|
| 1,641,044 | A * | 8/1927 | Murphy | 49/386 |
| 2010/0295428 | A1* | 11/2010 | Favaro et al. | 312/228 |
| 2011/0018408 | A1* | 1/2011 | Cho et al. | 312/228 |
| 2012/0285096 | A1* | 11/2012 | Green | 49/366 |
| 2014/0115970 | A1* | 5/2014 | Lee | 49/386 |
| 2014/0375188 | A1* | 12/2014 | Park et al. | 312/228 |

FOREIGN PATENT DOCUMENTS

| | | |
|---|---|---|
| JP | 2005143794 | 6/2005 |
| JP | 2008272034 | 11/2008 |

* cited by examiner

*Primary Examiner* — Daniel Rohrhoff

(74) *Attorney, Agent, or Firm* — Dentons US LLP

(57) ABSTRACT

A laundry treatment apparatus including a front panel with an inclined front surface and an opening for the introduction and removal of laundry located on the inclined surface, a door rotatably mounted to the inclined front surface to open or close the opening, and a damper module between the front panel and the door to apply torque to the door in a direction opposite to a rotating direction of the door when the door is rotated due to self-load (or self-weight) of the door. The damper module applies torque to the door in a direction opposite to a rotating direction of the door when an angle between the front panel and the door is within a range of a prescribed angle, preventing the door from being open or closed due to self-load (or self-weight) of the door, enhancing user convenience.

13 Claims, 8 Drawing Sheets

LAUNDRY TREATMENT APPARATUS

Pursuant to 35 U.S.C. §119(a), this application claims the benefit of Korean Patent Application No. 10-2013-0030404, filed on Mar. 21, 2013, which is hereby incorporated by reference as if fully set forth herein.

BACKGROUND

1. Field

The present disclosure relates to a laundry treatment apparatus which may prevent rotation of a door due to self-load (or self-weight) of the door.

2. Discussion of the Related Art

Laundry treatment apparatuses are home appliances capable of washing and/or drying laundry (e.g., clothing), and include a washing machine, a drying machine, and a combined drying and washing machine.

A laundry treatment apparatus capable of drying laundry supplies high temperature air (i.e., hot air) to laundry, and may be divided into an exhaust type laundry treatment apparatus and a circulation type (a.k.a., a condensation type) laundry treatment apparatus based on an air flow method.

A circulation type laundry treatment apparatus removes moisture (i.e., dehumidifies) of the air discharged from a receiving space, heats, and resupplies the air into the receiving space.

An exhaust type laundry treatment apparatus supplies heated air into a receiving space and exhausts air discharged from the receiving space to the outside of the laundry treatment apparatus rather than resupplying the air into the receiving space.

A typical drum type laundry treatment apparatus is provided with a laundry input opening in a front surface thereof, and includes a door configured to open or close the opening. In this case, the front surface of the laundry treatment apparatus provided with the opening may be inclined to further facilitate introduction of laundry. A user may introduce laundry to be washed, or remove completely washed laundry, through the inclined opening with less bending at the waist.

However, as the door is mounted to the inclined front surface and thus is tilted, automatic rotation of the door may problematically occur because of generated torque due to self-load (or self-weight) of the door. That is, when the user opens the door and tries to introduce laundry, the user may suffer from inconvenience as the door is automatically rotated in a closing direction due to self-load (or self-weight) of the door to thereby close the opening. Likewise, when the door is rotated beyond a prescribed angle to avoid automatic closing, there is a risk of the door being damaged by external shock as the door is rotated in an opening direction due to self-load (or self-weight) of the door to thereby be opened to the maximum angle.

SUMMARY

Accordingly, one or more embodiments of the present invention are directed to a laundry treatment apparatus that substantially obviates one or more problems due to the limitations and disadvantages of the related art.

One object of the present invention is to provide a laundry treatment apparatus which may prevent rotation of a door in an opening direction or closing direction due to self-load (or self-weight) of the door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, as embodied and broadly described herein, a laundry treatment apparatus includes a front panel with an inclined front surface and an opening for the introduction and removal of laundry located on the inclined front surface, a door rotatably mounted to the inclined front surface to open or close the opening, and a damper module between the front panel and the door to apply torque to the door in a direction opposite to a rotating direction of the door when the door is rotated due to self-load (or self-weight) of the door, whereby it is possible to prevent the door from being open or closed due to self-load (or self-weight) of the door.

The damper module may include an elastic member including a coil portion to rotate in the same direction as a rotating direction of the door when torque of the door is applied to the elastic member, and a guide member to generate torsional stress of the coil portion in a direction opposite to a rotating direction of the door by restricting rotation of the coil portion when an angle between the front panel and the door is within a range of a prescribed angle.

In this case, the elastic member may be a torsion spring.

The elastic member may further include a door fixing portion and a guide fixing portion extending respectively from both ends of the coil portion, the door fixing portion being fixed to the door to transmit torque of the door to the coil portion, and the guide fixing portion being fixed to the guide member, the guide member may have a guide groove extending in a circumferential direction thereof, into which the guide fixing portion is inserted to be movable in a rotating direction of the door, and the guide groove restricts movement of the guide fixing portion in a rotating direction of the door when an angle between the front panel and the door is within a range of the prescribed angle.

The elastic member may apply torque to the door in an opening direction of the door as rotation of the guide fixing portion in a closing direction of the door is restricted by one side of the guide groove when an angle between the front panel and the door is within a range of $0° < \beta < 100°$, whereby it is possible to prevent the door from being closed due to self-load (or self-weight) of the door.

The elastic member may apply torque to the door in a closing direction of the door as rotation of the guide fixing portion in an opening direction of the door is restricted by the other side of the guide groove when an angle between the front panel and the door is within a range of $100° < \Theta < 180°$, whereby it is possible to prevent the door from being open due to self-load (or self-weight) of the door.

The guide member may have a first guide groove and a second guide groove, and the elastic member may include a first elastic member including a first door fixing portion fixed to the door, a first guide fixing portion inserted into the first guide groove, and a first coil portion extending between the first door fixing portion and the first guide fixing portion, the first coil portion having a plurality of windings, and a second elastic member including a second door fixing portion fixed to the door, a second guide fixing portion inserted into the second guide groove, and a second coil portion extending between the second door fixing portion and the second guide fixing portion, the second coil portion having a plurality of windings.

The damper module may include a damper shaft provided between the front panel and the door and arranged parallel to a rotation axis of the door, the center of the guide member may be fixed to the damper shaft, and the coil portion of the elastic member may have plural windings surrounding the damper shaft.

The front panel may include a first coupling piece and a second coupling piece arranged at upper and lower positions, the first coupling piece and the second coupling piece may be provided at facing surfaces thereof with fixing recesses to which both ends of the damper shaft are fixed, and the first coupling piece and the second coupling piece may be provided at the other surfaces thereof with a first hinge and a second hinge to which the door is rotatably coupled.

The damper module may further include a coupling bracket rotatably provided at the damper shaft and fixed to the door. The damper module may be firmly fixed between the front panel and the door.

The laundry treatment apparatus may further include a damper cover configured to cover the damper module to prevent the damper module from being separated between the front panel and the door, thereby preventing damage to the damper module caused when the damper module is exposed to the outside.

The first elastic member and the second elastic member may be torsion springs.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiment(s) of the invention and together with the description serve to explain the principles of the invention. In the drawings.

DETAILED DESCRIPTION

Figure 1:
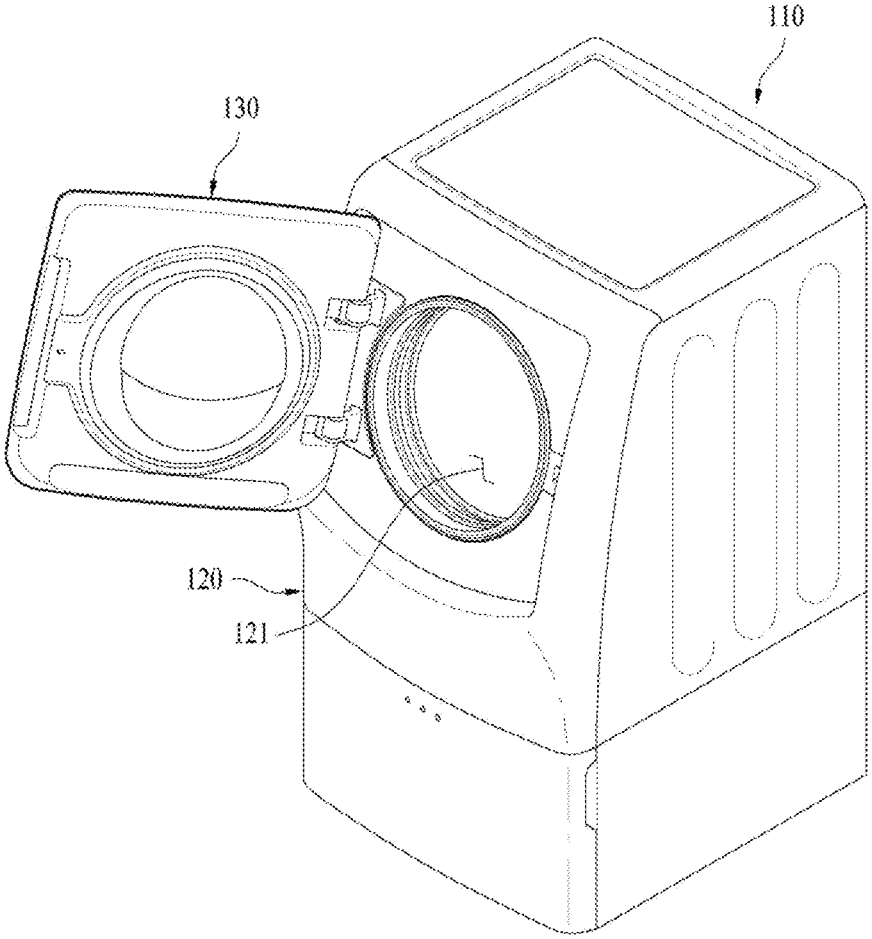
FIG. 1 is a perspective view of a laundry treatment apparatus according to one embodiment of the present invention.

Hereinafter, embodiments of the present invention will be described in detail with reference to the accompanying drawings.

Unless specially defined, all terms of the specification may be commonly understood by those skilled in the art to have the same meaning as the general meaning, and may be defined in the specification when having a specific meaning conflicting with the general meaning thereof.

Meanwhile, a configuration or a control method of an apparatus that will be described hereinafter is provided for explanation of the embodiments of the present invention, and is not intended to limit a technical range of the present invention. The same reference numerals of the entire specification designate the same constituent elements.

FIG. 1 is a perspective view of a laundry treatment apparatus according to one embodiment of the present invention.

The laundry treatment apparatus of one embodiment of the present invention includes a cabinet 110, a front panel 120 mounted to a front side of the cabinet 110 and having an opening 121 for introduction of laundry (an object to be washed or an object to be dried), and a door 130 mounted to front panel 120 to open or close opening 121.

Front panel 120 may have an inclined front surface, and opening 121 may be formed in the inclined front surface. This causes opening 121 to be tilted, thereby allowing a user to introduce or remove laundry into or from the laundry treatment apparatus through opening 121 without significantly bending at the waist.

Door 130 is pivotally rotatably mounted to the front surface of front panel 120. As the front surface of front panel 120, to which door 130 is mounted, is inclined, door 130 is pivotally rotated about a rotational axis tilted by a prescribed angle.

Figure 2:
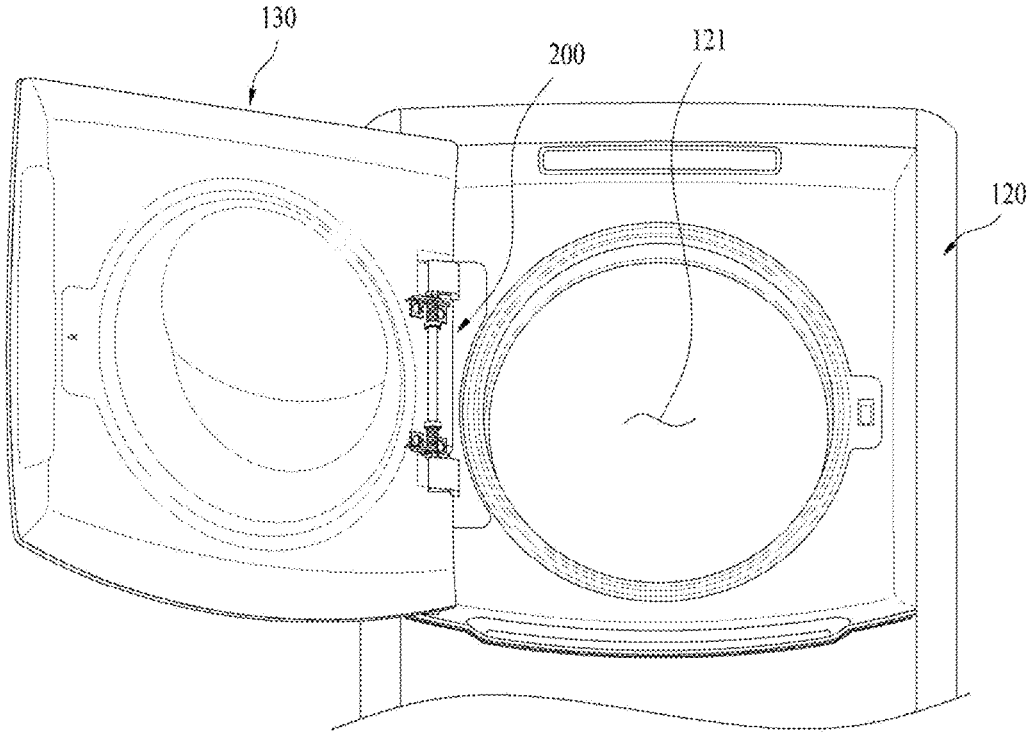
FIG. 2 is a front view showing a damper module provided between a front panel and a door according to one embodiment of the present invention.

As exemplarily shown in FIG. 2, the laundry treatment apparatus of the present invention includes a damper module 200 between the front panel 120 and the door 130. The damper module 200 is fixed between front panel 120 and one side of door 130 coupled to front panel 120.

Damper module 200 serves to apply torque to door 130 in a direction opposite to a rotating direction of door 130 when door 130 is rotated due to self-load (or self-weight) of the door. In this way, damper module 200 may prevent door 130 from being automatically rotated due to self-load (or self-weight) of the door and consequently from being unintentionally opened or closed without user force.

In this context, that door 130 is rotated due to self-load (or self-weight) of the door refers to torque being generated in a circumferential direction of a rotational axis of door 130 due to the weight of door 130 when an angle between front panel 120 and door 130 is within a range of a prescribed angle $\Theta$.

More specifically, damper module 200 may apply torque to door 130 when an angle between front panel 120 and door 130 is within a range of a prescribed angle $\Theta$, thereby restricting rotation of door 130 due to self-load (or self-weight) of the door. Torque applied to door 130 by the damper module 200 is in an opposite direction, to torque of door 130 due to self-load (or self-weight) of the door, and is of equal or less magnitude than the torque of door 130 due to self-load (or self-weight) of the door. Preferably, the magnitude of torque applied to door 130 by damper module 200 may be equal to the magnitude of torque of door 130 due to self-load (or self-weight) of the door.

Hereinafter, damper module 200 according to the present invention will be described in detail with reference to the accompanying drawings.

Figure 3:
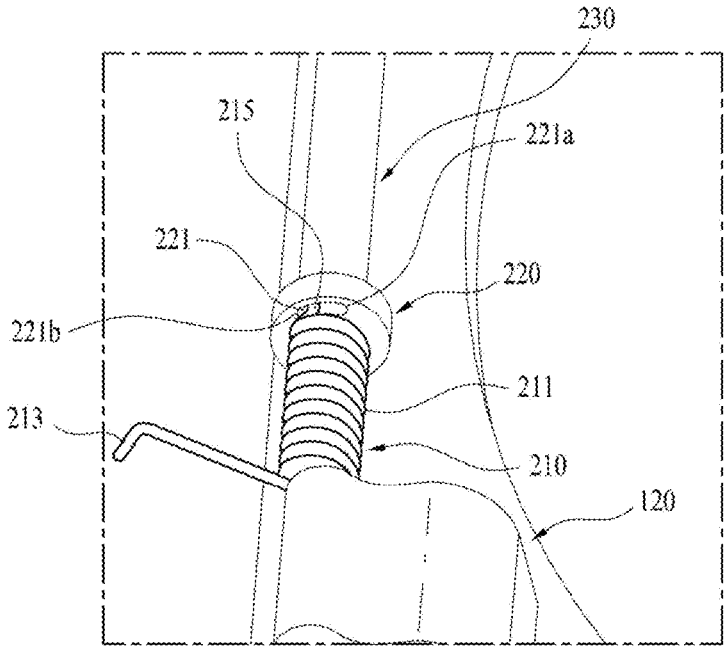
FIG. 3 is a perspective view of an elastic member and a guide member according to one embodiment of the present invention.

As exemplarily shown in FIG. 3, damper module 200 includes an elastic member 210 and a guide member 220. Elastic member 210 functions to apply torque to door 130 in a direction opposite to a rotating direction of door 130 due to self-load (or self-weight) of the door. Guide member 220 serves to control elastic member 210 such that elastic member 210 applies torque to door 130 in a direction opposite to a rotating direction of door 130 due to self-load (or self-weight) of the door only when an angle between front panel 120 and door 130 is within a range of a prescribed angle ⊖.

According to one embodiment, elastic member 210 includes a coil portion 211 configured to be rotated in the same direction as a rotating direction of door 130 upon receiving torque of door 130. Coil portion 211 takes the form of a coil having plural windings to generate torsional stress. Coil portion 211 is rotated in the same direction as a rotating direction of door 130 as torque of door 130 is applied to coil portion 211 during rotation of door 130.

In this case, guide member 220 serves to restrict rotation of coil portion 211, thereby causing elastic member 210 to apply torque in a direction opposite to a rotating direction of door 130 due to self-load (or self-weight) of the door. That is, guide member 220 prevents coil portion 211 from being rotated in a rotating direction of door 130 due to self-load (or self-weight) of the door when an angle between front panel 120 and door 130 is within a range of a prescribed angle ⊖.

If rotation of coil portion 211 in a rotating direction of door 130 is restricted, torsion of coil portion 211 occurs. As such, coil portion 211 generates torsional stress that is a repulsive force to return to an original state thereof. The torsional stress has a direction opposite to a rotating direction of door 130. Accordingly, owing to the torsional stress of coil portion 211, elastic member 210 may apply torque to door 130 in a direction opposite to a rotating direction of door 130 due to by self-load (or self-weight) of the door.

According to one embodiment, elastic member 210 further includes a door fixing portion 213 and a guide fixing portion 215 extending respectively from both ends of coil portion 211.

Door fixing portion 213 extends from one end of coil portion 211 and is fixed to door 130. Door fixing portion 213 rotates coil portion 211 in a rotating direction of door 130 upon receiving torque of door 130. In addition, as torsional stress of coil portion 211 is transmitted to door fixing portion 213, door fixing portion 213 transmits torque to door 130 in a direction opposite to a rotating direction of door 130 due to self-load (or self-weight) of the door. Meanwhile, door fixing portion 213 is fixed to door 130, and thus is rotated in the same manner as rotation of door 130.

Guide fixing portion 215 extends from the other end of coil portion 211 and is fixed to guide member 220. Guide fixing portion 215 receives force from guide member 220 to restrict rotation of coil portion 211 when an angle between front panel 120 and door 130 is within a range of the prescribed angle ⊖.

Meanwhile, guide member 220 has a guide groove 221 into which guide fixing portion 215 is inserted. Guide fixing portion 215 is movably inserted into guide groove 221. That is, guide fixing portion 215 is moved in guide groove 221 in a rotating direction of door 130 as door 130 is rotated. Guide groove 221 may extend in a circumferential direction of guide member 220.

In this case, guide groove 221 extends by a predetermined length L to restrict movement of guide fixing portion 215 in a rotating direction of door 130 when an angle between front panel 120 and door 130 is within a range of the prescribed angle ⊖. Upon rotation of door 130, guide fixing portion 215 is moved in guide groove 221 in a rotating direction of door 130. Then, such movement of guide fixing portion 215 is restricted by one side 221*a* of guide groove 221.

Hereinafter, interactive force between door 130, elastic member 210, and guide member 220 when torque of door 130 due to self-load (or self-weight) of the door is generated will be described. Torque of door 130 due to self-load (or self-weight) of the door is applied to door fixing portion 213 even if the user does not apply force to door 130 when an angle between front panel 120 and door 130 is within a range of the prescribed angle ⊖. As such, coil portion 211 and guide fixing portion 215, which extend from door fixing portion 213, tend to be rotated in a rotating direction of door 130 due to self-load (or self-weight) of the door.

In this case, movement of guide fixing portion 215 is restricted by one side 221*a* of guide groove 221. Torque of door 130 due to self-load (or self-weight) of the door is continuously applied to door fixing portion 213, whereas a repulsive force to restrict movement is applied to guide fixing portion 215 by one side 221 a of guide groove 221. Thereby, torsion of coil portion 211 occurs. As a result, coil portion 211 applies torsional stress, which is a repulsive force to return to an original state thereof, to door 130 through door fixing portion 213. The torsional stress is torque in a direction opposite to a rotating direction of door 130 due to self-load (or self-weight) of the door, thereby preventing door 130 from being rotated by self-load (or self-weight) of the door.

Figure 4:
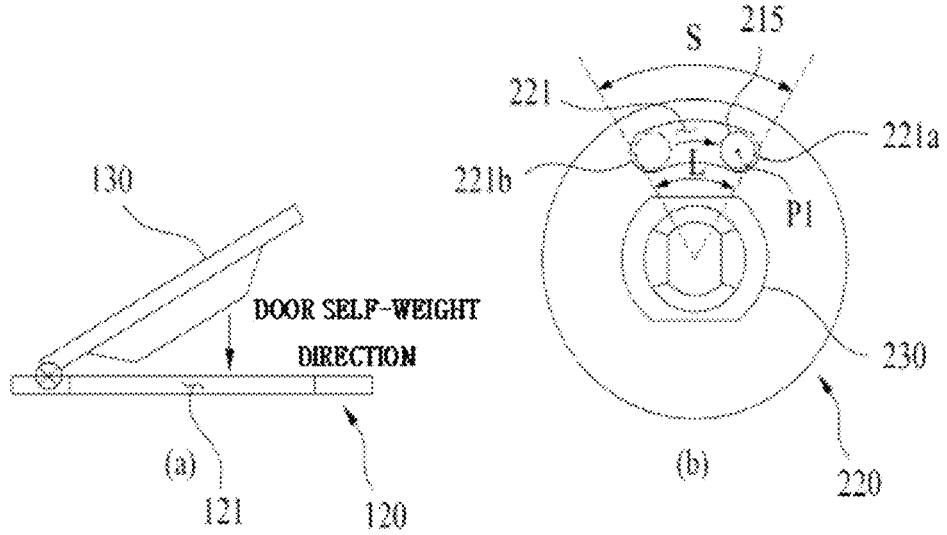
FIG. 4(*a*) is a sectional view showing self-load (or self-weight) of the door applied to the door to generate torque in a door closing direction according to one embodiment of the present invention, and FIG. 4(*b*) is a plan view showing operation of the guide member and the elastic member to generate torque in a door opening direction.
Figure 5:
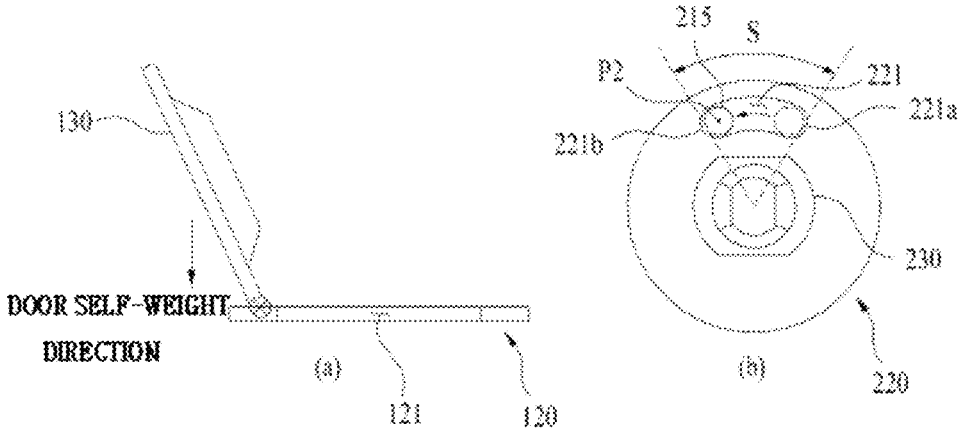
FIG. 5(*a*) is a sectional view showing self-load (or self-weight) of the door applied to the door to generate torque in a door opening direction according to one embodiment of the present invention, and FIG. 5(*b*) is a plan view showing operation of the guide member and the elastic member to generate torque in a door closing direction.

With reference to FIGS. 4 and 5, operation of damper module 200 to prevent door 130 from being rotated in a closing direction as well as an opening direction due to self-load (or self-weight) of the door will be described respectively.

First, as exemplarily shown in FIG. 4(*a*), when door 130 is rotated and an angle between front panel 120 and door 130 becomes less than a prescribed angle (e.g., a first setting angle), torque of door 130 due to self-load (or self-weight) of the door is generated in a closing direction of door 130.

In this case, as exemplarily shown in FIG. 4(*b*), guide fixing portion 215 is moved within a specific section S of guide groove 221 in a rotating direction of door 130 as door 130 is rotated. Then, movement of guide fixing portion 215 is restricted by one side 221*a* of guide groove 221 when an angle between front panel 120 and door 130 becomes less than the first setting angle.

That is, when an angle between front panel 120 and door 130 becomes less than the first setting angle, guide fixing portion 215 is located at a position P1 where guide fixing portion 215 comes into contact with one side 221*a* of guide groove 221, which restricts movement of guide fixing portion 215. Thus, torsion of coil portion 211 occurs. As a result, when an angle between front panel 120 and door 130 is less than the first setting angle, damper module 200 applies torque depending on torsional stress of coil portion 211 to door 130 in a direction opposite to a rotating direction of door 130 due to self-load (or self-weight) of the door, i.e. in an opening direction of door 130.

According to at least one embodiment, when an angle ⊖ between front panel 120 and door 130 is within a range of 0°<⊖<100°, movement of guide fixing portion 215 in a closing direction of door 130 may be restricted by one side 221*a* of guide groove 221. As such, damper module 200 applies torque to door 130 in an opening direction of door 130 when an angle between front panel 120 and door 130 is within a range of 0°<⊖<100°.

That is, on the basis of the first setting angle of 100°, damper module 200 applies torque in an opening direction of door 130 opposite to a rotating direction of door 130 due to self-load (or self-weight) of the door.

Next, as exemplarily shown in FIG. 5(*a*), when door 130 is rotated and an angle between front panel 120 and door 130 exceeds a prescribed angle (e.g., a second setting angle), torque of door 130 due to self-load (or self-weight) of the door is generated in an opening direction of door 130.

In this case, as exemplarily shown in FIG. 5(*b*), guide fixing portion 215 is moved within a specific section S of guide groove 221 in a rotating direction of door 130 as door 130 is rotated. Then, movement of guide fixing portion 215 is restricted by the other side 221*b* of guide groove 221 when an angle between front panel 120 and door 130 exceeds the second setting angle.

Accordingly, when an angle between front panel 120 and door 130 is greater than the second setting angle, damper module 200 applies torque depending on torsional stress of coil portion 211 to door 130 in a direction opposite to a rotating direction of door 130 due to self-load (or self-weight) of the door, i.e. in a closing direction of door 130.

According to at least one embodiment, when an angle ⊖ between front panel 120 and door 130 is within a range of 100°<⊖<180°, rotation of guide fixing portion 215 in an opening direction of door 130 may be restricted by the other side 221*b* of guide groove 221. As a result, damper module 200 applies torque to door 130 in a closing direction of door 130 when the angle ⊖ between front panel 120 and door 130 is within a range of 100°<⊖<180°.

It will be appreciated that the angle ⊖ between front panel 120 and door 130 for restriction of movement of guide fixing portion 215 may be within various ranges and is not limited to the above description. For example, it is possible to allow damper module 200 to apply torque to door 130 at a specific angle at which torque of door 130 due to self-load (or self-weight) of the door begins to be generated, and to allow damper module 200 to apply torque to door 130 when door 130 reaches a specific angle via rotation thereof due to self-load (or self-weight) of the door.

Additionally, according to the present invention, rotation of door fixing portion 213 may be restricted by one side 221*a* and the other side 221*b* of guide groove 221, which may prevent door 130 from being rotated in an opening direction as well as a closing direction due to self-load (or self-weight) of the door. Alternatively, movement of door fixing portion 213 may be restricted by any one of one side 221*a* or the other side 221*b* of guide groove 221 to prevent door 130 from being rotated in any one of an opening direction or a closing direction due to self-load (or self-weight) of the door.

Meanwhile, the angle ⊖ between front panel 120 and door 130 for restriction of movement of guide fixing portion 215 of guide member 220 may be adjusted by varying a length L of guide groove 221. If the length L of guide groove 221 is increased, an angle for restriction of rotation of door 130 in a closing direction due to self-load (or self-weight) of the door is reduced and an angle for restriction of rotation of door 130 in an opening direction due to self-load (or self-weight) of the door is increased.

On the contrary, if the length L of guide groove 221 is reduced, an angle for restriction of rotation of door 130 in a closing direction due to self-load (or self-weight) of the door is increased and an angle for restriction of rotation of door 130 in an opening direction due to self-load (or self-weight) of the door is reduced.

Figure 6:
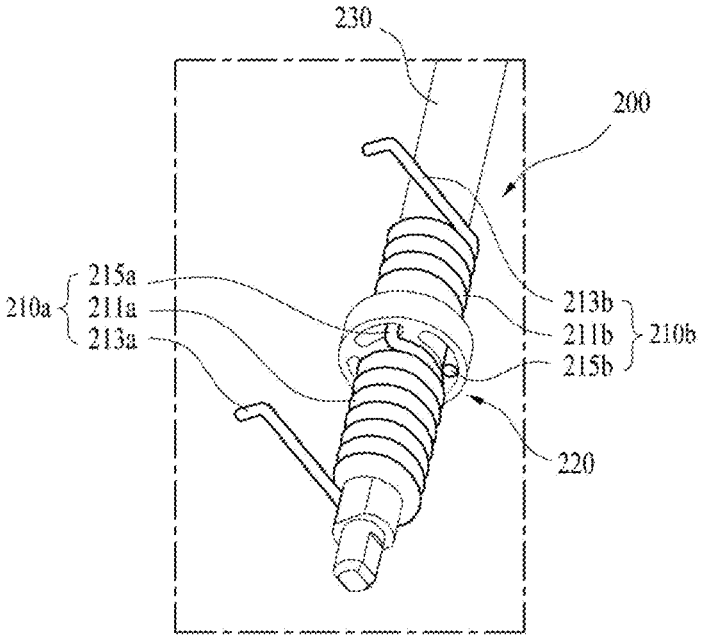
FIG. 6 is a perspective view showing a first elastic member, a second elastic member, and a guide member according to one embodiment of the present invention.
Figure 7:
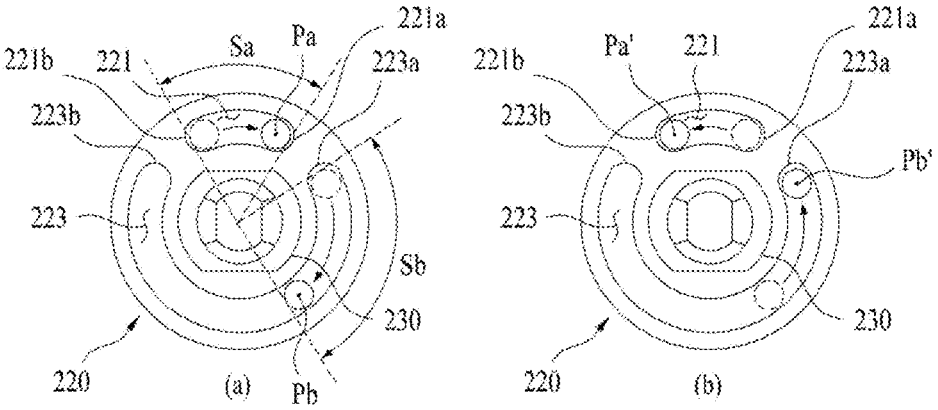
FIG. 7(*a*) is a plan view showing operation of the first elastic member, the second elastic member, and the guide member to generate torque in a door opening direction according to one embodiment of the present invention, and FIG. 7(*b*) is a plan view showing operation of the first elastic member, the second elastic member, and the guide member to generate torque in a door closing direction.

With reference to FIGS. 6 and 7, damper module 200 according to another embodiment of the present invention will be described. The same parts as the above description will hereinafter be described in brief or will not be described.

As exemplarily shown in FIG. 6, damper module 200 includes a first elastic member 210*a*, a second elastic member 210*b*, and a guide member 220 having a first guide groove 221 and a second guide groove 223 into which guide fixing portions 215*a* and 215*b* of first elastic member 210*a* and second elastic member 210*b* are respectively inserted.

First elastic member 210*a* and second elastic member 210*b* function to apply torque to door 130 in a direction opposite to a rotating direction of door 130 due to self-load (or self-weight) of the door. As will be described hereinafter, first elastic member 210*a* and second elastic member 210*b* may apply torque to door 130 at different ranges of the angle ⊖ between front panel 120 and door 130, and may apply torque to door 130 in different directions.

Guide member 220 serves to control first elastic member 210*a* and second elastic member 210*b* such that the first and second elastic members 210*a* and 210*b* apply torque to door 130 in a direction opposite to a rotating direction of door 130 due to self-load (or self-weight) of the door only when an angle between front panel 120 and door 130 is within a range of a prescribed angle ⊖.

According to at least one embodiment, first elastic member 210*a* may include a first door fixing portion 213*a* fixed to door 130, a first guide fixing portion 215*a* inserted into first guide groove 221, and a first coil portion 211*a* extending between first door fixing portion 213*a* and first guide fixing portion 215*a*, the first coil portion 211*a* having plural windings.

First door fixing portion 213*a* transmits torque of door 130 to first coil portion 211*a*. First coil portion 211 a is rotated in the same direction as a rotating direction of door 130 upon receiving torque of door 130 through first door fixing portion 213*a*. First guide fixing portion 215*a* integrally extends from first coil portion 211*a* and is moved in first guide groove 221 in the same direction as a rotating direction of first coil portion 211*a*.

Meanwhile, second elastic member 210*b* may include a second door fixing portion 213*b* fixed to door 130, a second guide fixing portion 215*b* inserted into second guide groove 223, and a second coil portion 211*b* extending between second door fixing portion 213*b* and second guide fixing portion 215*b*, second coil portion 211*b* having plural windings.

Likewise, torque of door 130 is transmitted from second door fixing portion 213*b* fixed to door 130 to second coil portion 211*b* and second guide fixing portion 215*b*. Thereby, second coil portion 211*b* and second guide fixing portion 215*b* are rotated in a rotating direction of door 130. That is, second guide fixing portion 215*b* is rotated in second guide groove 223 in a rotating direction of door 130.

In this case, guide member 220 selectively restricts rotation of first coil portion 211*a* or second coil portion 211*b*, thereby causing first elastic member 210*a* or second elastic member 210*b* to apply torque to door 130 in a direction opposite to a rotating direction of door 130 due to self-load (or self-weight) of the door.

That is, rotation of first coil portion 211*a* is restricted as movement of first guide fixing portion 215*a* is restricted by one side 221*a* of first guide groove 221 of guide member 220, and rotation of second coil portion 211*b* is restricted as movement of second guide fixing portion 215*b* is restricted by one side 223*a* of second guide groove 223.

With reference to FIG. 7, operation of damper module 200 to prevent rotation of door 130 in a closing direction and an opening direction due to self-load (or self-weight) of the door will be described in detail.

First, considering a process of preventing door 130 from being closed due to self-load (or self-weight) of the door, when door 130 is rotated and an angle between front panel 120 and door 130 becomes less than a prescribed angle (e.g., a first setting angle), torque of door 130 due to self-load (or self-weight) of the door is generated in a closing direction of door 130.

As exemplarily shown in FIG. 7(*a*), first guide fixing portion 215*a* is moved within a specific section Sa of first guide groove 221 in a rotating direction of door 130 as door 130 is rotated. Then, movement of first guide fixing portion 215*a* is restricted by one side 221*a* of first guide groove 221 when an angle between front panel 120 and door 130 becomes less than the first setting angle.

That is, when an angle between front panel 120 and door 130 is less than the first setting angle, first guide fixing portion 215*a* is located at a position Pa where first guide fixing portion 215*a* comes into contact with one side 221*a* of first guide groove 221, which restricts movement of first guide fixing portion 215*a*. Thus, torsion of first coil portion 211*a* occurs. As a result, when an angle between front panel 120 and door 130 is less than the first setting angle, damper module 200 applies torque caused by torsional stress of first coil portion 211*a* to door 130 in a direction opposite to a rotating direction of door 130 due to self-load (or self-weight) of the door, i.e. in an opening direction of door 130.

In this case, second guide fixing portion 215*b* is moved within second guide groove 223 in a rotating direction of door 130. Different from first guide fixing portion 215*a*, movement of second guide fixing portion 215*b* is not restricted by one side 223*a* or the other side 223*b* of second guide groove 223 when an angle between front panel 120 and door 130 is less than the first setting angle. Accordingly, second elastic member 210*b* does not apply torque to door 130, and only first elastic member 210*a* applies torque to door 130 in an opening direction of door 130.

Next, considering a process of preventing door 130 from being open due to self-load (or self-weight) of the door, if door 130 is rotated and an angle between front panel 120 and door 130 exceeds a prescribed angle (e.g., a second setting angle), torque of door 130 due to self-load (or self-weight) of the door is generated in an opening direction of door 130.

In this case, as exemplarily shown in FIG. 7(*b*), second guide fixing portion 215*b* is moved within a specific section Sb of second guide groove 223 in a rotating direction of door 130 as door 130 is rotated. Then, movement of second guide fixing portion 215*b* is restricted by one side 223*a* of second guide groove 223 when an angle between front panel 120 and door 130 exceeds the second setting angle.

That is, when an angle between front panel 120 and door 130 exceeds the second setting angle, second guide fixing portion 215*b* is located at a position Pb where second guide fixing portion 215*b* comes into contact with one side 223*a* of second guide groove 223, which restricts movement of second guide fixing portion 215*b*. Thus, torsion of second coil portion 211*b* occurs. As a result, when an angle between front panel 120 and door 130 is greater than the second setting angle, damper module 200 applies torque caused by torsional stress of second coil portion 211*b* to door 130 in a direction opposite to a rotating direction of door 130 due to self-load (or self-weight) of the door, i.e. in a closing direction of door 130.

Meanwhile, although first guide fixing portion 215*a* is moved within first guide groove 221 in a rotating direction of door 130, differently from second guide fixing portion 215*b*, movement of first guide fixing portion 215*a* is not restricted by one side 221*a* or the other side 221*b* of first guide groove 221 when an angle between front panel 120 and door 130 is greater than the second setting angle. Accordingly, first elastic member 210*a* does not apply torque to door 130, and only second elastic member 210*b* applies torque to door 130 in a closing direction of door 130.

According to at least one embodiment, when an angle $\Theta$ between front panel 120 and door 130 is within a range of $0° < \Theta < 100°$, rotation of first guide fixing portion 215*a* in a closing direction of door 130 may be restricted by one side 221*a* of first guide groove 221. Torque of door 130 due to self-load (or self-weight) of the door is continuously applied to first door fixing portion 213*a*, whereas movement of first guide fixing portion 215*a* is restricted by one side 221*a* of first guide groove 221. Thus, torsion of first coil portion 211*a* occurs.

As a result, first coil portion 211*a* generates torsional stress to return to an original state thereof. First elastic member 210*a* transmits torque depending on the torsional stress to door 130 through first door fixing portion 213*a* in a direction opposite to a rotating direction of door 130 due to self-load (or self-weight) of the door.

When an angle $\Theta$ between front panel 120 and door 130 is within a range of $100° < \Theta < 180°$, rotation of second guide fixing portion 215*b* in an opening direction of door 130 may be restricted by one side 223*a* of second guide groove 223. As a result, as torsion of second coil portion 211*b* occurs, second elastic member 210*b* applies torque to door 130 in a closing direction of door 130.

Meanwhile, first coil portion 211*a* and second coil portion 211*b* may have different numbers of windings. Thus, first coil portion 211*a* and second coil portion 211*b* have different values of torsional stress. This is because first door fixing portion 213*a* and second door fixing portion 213*b* are fixed to door 130 at different positions, and therefore it is necessary to apply different magnitudes of torques to door 130 in order to prevent door 130 from being rotated by self-load (or self-weight) of the door.

Additionally, first door fixing portion 213*a* and second door fixing portion 213*b* may be fixed to door 130 at different horizontal positions. Through adoption of different horizontal fixing positions with respect to door 130, first guide fixing portion 215*a* and second guide fixing portion 215*b* may exhibit different displacements in first guide groove 221 and second guide groove 223 on the basis of the same rotation angle of door 130.

In the above-described case, it is possible to prevent guide member 220 from restricting movement of first guide fixing portion 215*a* and movement of second guide fixing portion 215*b* simultaneously due to increase in displacements of first guide fixing portion 215*a* and second guide fixing portion 215*b*.

Additionally, the first guide groove 221 and the second guide groove 223 may be formed in the guide member 220 by different lengths. As such, the first guide fixing portion 215*a* and the second guide fixing portion 215*b* may be moved in the first guide groove 221 and the second guide groove 223 of the guide member 220 by different displacements during rotation of the door 130.

First elastic member 210*a* and second elastic member 210*b* may be located respectively at upper and lower sides of guide member 220. First guide fixing portion 215*a* may be inserted into first guide groove 221 from the upper side of guide member 220, and second guide fixing portion 215*b* may be inserted into second guide groove 223 from the lower side of guide member 220. This may ensure easy spatial arrangement of first guide fixing portion 215*a* and second guide fixing portion 215*b* fixed to guide member 220.

Meanwhile, damper module 200 may include a damper shaft 230 to which guide member 220 and elastic member 210 are fixed. Damper shaft 230 is provided between front panel 120 and door 130 and is arranged parallel to a rotation axis of door 130. Damper shaft 230 is inserted through a coupling bore (not shown) formed in guide member 220. Coil portion 211 of elastic member 210 may take the form of a coil having plural windings to surround damper shaft 230. Coil portion 211 may be rotated about damper shaft 230 as door 130 is rotated.

Figure 8:
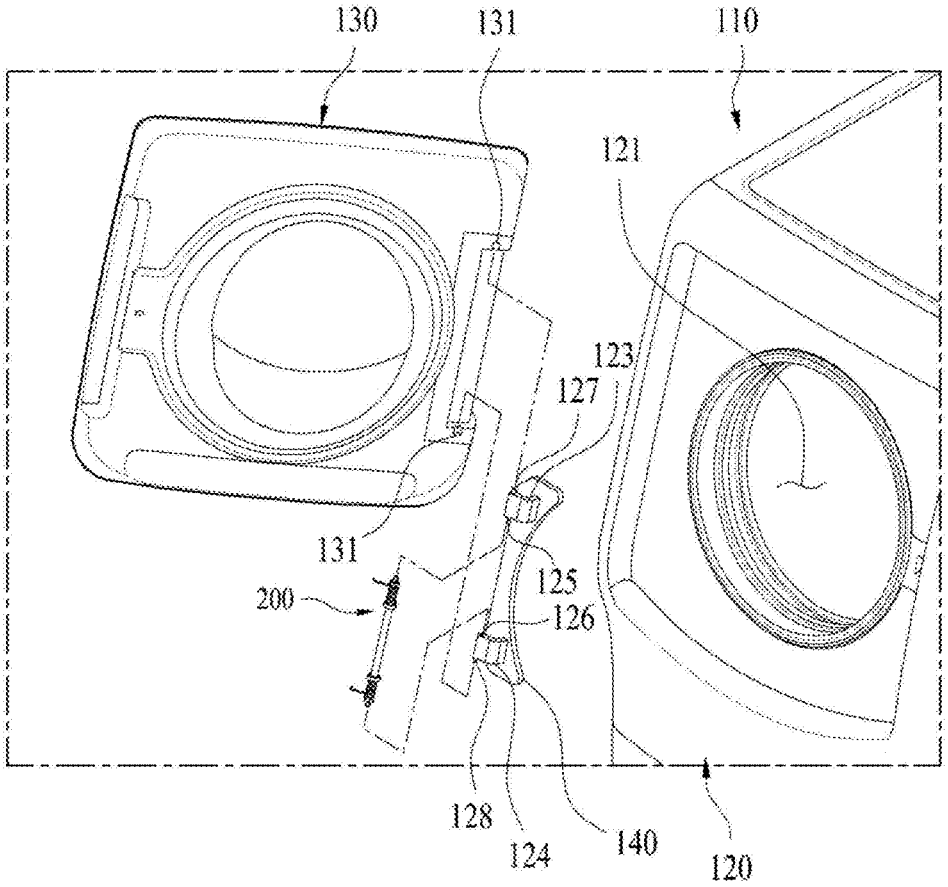
FIG. 8 is an exploded perspective view of a door, a damper module, and a front panel according to one embodiment of the present invention.

As exemplarily shown in FIG. 8, front panel 120 includes a first coupling piece 123 and a second coupling piece 124, which are arranged at upper and lower positions of front panel 120 to protrude outward. First coupling piece 123 and second coupling piece 124 may be provided at a separate support member 140, and support member 140 may be attached to front panel 120.

First coupling piece 123 and second coupling piece 124 may be provided at facing surfaces thereof with fixing recesses 125 and 126 to which both ends of damper shaft 230 are fixed. As both ends of damper shaft 230 are inserted into fixing recesses 125 and 126, damper shaft 230 is located between front panel 120 and door 130.

The other surfaces of first coupling piece 123 and second coupling piece 124 are provided respectively with a first hinge 127 and a second hinge 128 to which door 130 is pivotally rotatably coupled. First hinge 127 and second hinge 128 are respectively inserted into hinge recesses 131 of door 130 such that door 130 is pivotally rotatable about first hinge 127 and second hinge 128.

Figure 9:
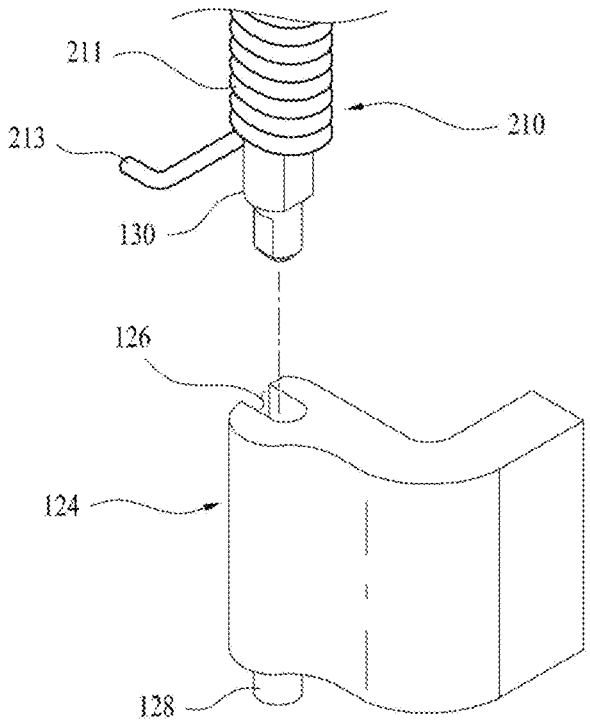
FIG. 9 is a perspective view showing coupling between a damper shaft and a front panel according to one embodiment of the present invention.

As exemplarily shown in FIG. 9, fixing recesses 125 and 126 may have flat inner surfaces to prevent rotation of damper shaft 230. Likewise, both ends of damper shaft 230 may have a shape corresponding to the shape of fixing recesses 125 and 126.

Figure 10:
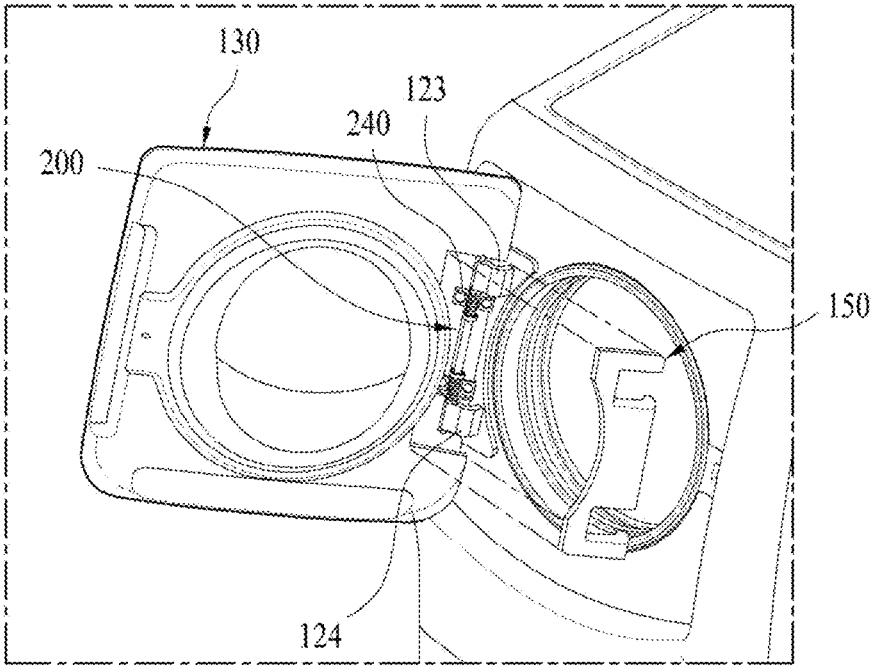
FIG. 10 is a perspective view showing a coupling bracket and a damper cover according to one embodiment of the present invention.

As exemplarily shown in FIG. 10, damper module 200 may further include coupling brackets 240 provided at damper shaft 230. Coupling brackets 240 are rotatably disposed on damper shaft 230 and are fixed at both sides thereof to door 130. That is, both ends of damper shaft 230 are not only fixed to front panel 120, but also fixed to door 130 via coupling brackets 240, which prevents damper shaft 230 from being separated between front panel 120 and door 130.

Additionally, damper module 200 may further include a damper cover 150 configured to cover damper module 200. Damper cover 150 is coupled to door 130 to cover damper module 200. Damper cover 150 serves to prevent damper module 200 from being exposed to the outside, thereby preventing damage to damper module 200 and providing damper module 200 with a pleasing external appearance.

That is, according to another embodiment of the present invention, damper module 200 applies torque to door 130 in a direction opposite to a rotating direction of door 130 when an angle between front panel 120 and door 130 is within a range of a prescribed angle $\Theta$, in order to prevent door 130 from being opened or closed by self-load (or self-weight) of the door.

Damper module 200 includes first elastic member 210*a*, second elastic member 210*b*, and guide member 220.

First elastic member 210*a* and second elastic member 210*b* include coil portions 211*a* and 211*b* respectively, and apply torque caused by torsional stress of coil portions 211*a* and 211*b* to door 130 in a direction opposite to a rotating direction of door 130.

Guide member 220 induces torsional stress of coil portion 211*a* of first elastic member 210*a* when an angle between front panel 120 and door 130 is within a range of a first angle, and induces torsional stress of coil portion 211*b* of second elastic member 210*b* when an angle between front panel 120 and door 130 is within a range of a second angle.

Additionally, first elastic member 210*a* includes door fixing portion 213*a* and guide fixing portion 215*a* extending respectively from both ends of coil portion 211*a*, door fixing portion 213*a* being fixed to door 130 such that torque of door 130 is transmitted to door fixing portion 213*a*, and guide fixing portion 215*a* being fixed to guide member 220. Likewise, second elastic member 210*b* includes door fixing portion 213*b* and guide fixing portion 215*b* extending respectively from both ends of coil portion 211*b*, door fixing portion 213*b* being fixed to door 130 and guide fixing portion 215*b* being fixed to guide member 220.

Guide member 220 includes first guide groove 221 and second guide groove 223 into which guide fixing portion 215*a* of first elastic member 210*a* and guide fixing portion 215*b* of second elastic member 210*b* are inserted respectively so as to be movable in a rotating direction of door 130.

First guide groove 221 restricts movement of guide fixing portion 215*a* of first elastic member 210*a* in a rotating direction of door 130 when an angle between front panel 120 and door 130 is within a range of a first angle, thereby inducing torsional stress. Second guide groove 223 restricts movement of guide fixing portion 215*b* of second elastic member 210*b* in a rotating direction of door 130 when an angle between front panel 120 and door 130 is within a range of a second angle, thereby inducing torsional stress. The torsional stress is a repulsive force of coil portion 211*a* or 211*b* to return to an original state thereof, and is applied in a direction opposite to a rotating direction of door 130 due to self-load (or self-weight) of the door.

That is, when an angle between front panel 120 and door 130 is within a range of the first angle, rotation of guide fixing portion 215*a* of first elastic member 210*a* in a closing direction of door 130 is restricted by one side 221*a* of first guide groove 221. Thereby, first elastic member 210*a* applies torque to door 130 in an opening direction of door 130.

Additionally, when an angle between front panel 120 and door 130 is within a range of the second angle, rotation of guide fixing portion 215*b* of second elastic member 210*b* in an opening direction of door 130 is restricted by one side 223*a* of second guide groove 223. Thereby, second elastic member 210*b* applies torque to door 130 in a closing direction of door 130.

In this case, the first angle is within a range of $0° < \Theta < 100°$, and the second angle is within a range of $100° < \Theta < 180°$.

As is apparent from the above description, according to the present invention, a damper module applies torque to a door in a direction opposite to a rotating direction of the door when an angle between a front panel and the door is within a range of a prescribed angle, thereby preventing rotation of the door due to self-load (or self-weight) of the door.

More specifically, according to the present invention, when the angle between the front panel and the door is within a range of $0° < \Theta < 100°$, the damper module applies torque to the door in an opening direction of the door, thereby preventing the door from being rotated by self-load (or self-weight) of the door to thereby close an opening.

According to the present invention, when the angle between the front panel and the door is within a range of $100° < \Theta < 180°$, the damper module applies torque to the door in a closing direction of the door, thereby preventing the door from being rotated in an opening direction to the maximum angle by self-load (or self-weight) of the door and consequently preventing damage to the door due to shock.

Further, according to the present invention, a damper shaft of the damper module is fixed at both ends thereof to the front panel, and a coupling bracket is rotatably provided at the damper shaft and fixed to the door. With this configuration, the damper module may be firmly fixed between the front panel and the door.

Furthermore, according to the present invention, a damper cover is provided to cover the damper module, which may prevent the damper module from being exposed to the outside.

It will be apparent that, although the preferred embodiments have been shown and described above, the invention is not limited to the above-described specific embodiments, and various modifications and variations can be made by those skilled in the art without departing from the concept of the appended claims.

What is claimed is:

1. A laundry treatment apparatus comprising:

a front panel with an inclined front surface and an opening for the introduction and removal of laundry located on the inclined front surface;

a door rotatably mounted to the inclined front surface to open or close the opening; and a damper module between the front panel and the door to apply torque to the door in a direction opposite to a rotating direction of the door when the door is rotated due to self-weight of the door, wherein the damper module includes:

an elastic member including a coil portion to rotate in the same direction as a rotating direction of the door when torque of the door is applied to the elastic member; and a guide member to generate torsional stress of the coil portion in a direction opposite to a rotating direction of the door by restricting rotation of the coil portion when an angle between the front panel and the door is within a range of a prescribed angle, wherein the elastic member further includes:

a door fixing portion and a guide fixing portion extending respectively from both ends of the coil portion, the door fixing portion being fixed to the door to transmit torque of the door to the coil portion, and the guide fixing portion being fixed to the guide member, and wherein the guide member has a guide groove extending in a circumferential direction thereof, into which the guide fixing portion is inserted to be movable in a rotating direction of the door.

2. The apparatus of claim 1, wherein the guide groove restricts movement of the guide fixing portion in a rotating direction of the door when an angle between the front panel and the door is within a range of the prescribed angle.

3. The apparatus of claim 2, wherein the elastic member applies torque to the door in an opening direction of the door as rotation of the guide fixing portion in a closing direction of the door is restricted by one side of the guide groove when an angle between the front panel and the door is within a range of $0° < \Theta < 100°$.

4. The apparatus of claim 2, wherein the elastic member applies torque to the door in a closing direction of the door as rotation of the guide fixing portion in an opening direction of the door is restricted by the other side of the guide groove when an angle between the front panel and the door is within a range of $100° < \Theta < 180°$.

5. The apparatus of claim 2, wherein the guide member has a first guide groove and a second guide groove, and wherein the elastic member includes:

a first elastic member including a first door fixing portion fixed to the door, a first guide fixing portion inserted into the first guide groove, and a first coil portion extending between the first door fixing portion and the first guide fixing portion, the first coil portion having a plurality of windings; and a second elastic member including a second door fixing portion fixed to the door, a second guide fixing portion inserted into the second guide groove, and a second coil portion extending between the second door fixing portion and the second guide fixing portion, the second coil portion having a plurality of windings.

6. The apparatus of claim 5, wherein the first elastic member applies torque to the door in an opening direction of the door as movement of the first guide fixing portion in a closing direction of the door is restricted by one side of the first guide groove when an angle between the front panel and the door is within a range of $0° < \Theta < 100°$, and wherein the second elastic member applies torque to the door in a closing direction of the door as movement of the second guide fixing portion in an opening direction of the door is restricted by one side of the second guide groove when an angle between the front panel and the door is within a range of $100° < \Theta < 180°$.

7. The apparatus of claim 5, wherein the number of windings in the first coil portion and the second coil portion are different.

8. The apparatus of claim 7, wherein the first guide groove and the second guide groove are formed in the guide member and have different lengths.

9. The apparatus of claim 5, wherein the first elastic member and the second elastic member are provided respectively at upper and lower sides of the guide member.

10. The apparatus of claim 2, wherein the damper module includes a damper shaft provided between the front panel and the door and arranged parallel to a rotation axis of the door, wherein the center of the guide member is fixed to the damper shaft, and wherein the coil portion of the elastic member has plural windings surrounding the damper shaft.

11. The apparatus of claim 10, wherein the front panel includes a first coupling piece and a second coupling piece arranged at upper and lower positions, wherein the first coupling piece and the second coupling piece are provided at facing surfaces thereof with fixing recesses to which both ends of the damper shaft are fixed, and wherein the first coupling piece and the second coupling piece are provided at the other surfaces thereof with a first hinge and a second hinge to which the door is rotatably coupled.

12. The apparatus of claim 11, wherein the damper module further includes a coupling bracket rotatably provided at the damper shaft and fixed to the door.

13. The apparatus of claim 11, further comprising:

a damper cover configured to cover the damper module to prevent the damper module from being separated between the front panel and the door.

* * * * *